United States Patent [19]

Allen et al.

[11] 4,025,344

[45] May 24, 1977

[54] LITHOGRAPHIC DEVELOPER REPLENISHMENT PROCESS

[75] Inventors: Charles Anthony Allen, Idaho Falls, Idaho; Thomas Albert Bailey, III, Wilmington, Del.; Joseph Anthony Sincius, Little Silver, N.J.

[73] Assignee: E. I. Du Pont de Nemours and Company, Wilmington, Del.

[22] Filed: May 23, 1975

[21] Appl. No.: 580,193

Related U.S. Application Data

[63] Continuation-in-part of Ser. No. 358,671, May 9, 1973, abandoned, which is a continuation-in-part of Ser. No. 285,126, Aug. 31, 1972, abandoned.

[52] U.S. Cl. ..... 96/50 A; 96/63; 96/66 R

[51] Int. Cl.[2] ..... G03C 5/26; G03C 5/24; G03C 5/30

[58] Field of Search ..... 96/63, 50 A, 66 R; 354/323, 324

[56] References Cited

UNITED STATES PATENTS

| | | | |
|---|---|---|---|
| 2,073,664 | 3/1937 | Weisberg et al. | 96/50 |
| 3,334,566 | 8/1967 | Friedel | 354/336 |
| 3,388,653 | 6/1968 | Mayfield | 354/321 |
| 3,472,143 | 10/1969 | Hixon et al. | 354/323 |
| 3,647,462 | 3/1972 | Surash | 96/66 |

FOREIGN PATENTS OR APPLICATIONS

| | | | |
|---|---|---|---|
| 2,004,893 | 8/1971 | Germany | 96/50 A |

OTHER PUBLICATIONS

Mason, Processing Chemistry, 1966, pp. 136–139, 147–151.

Ilford, Manual of Photography, 1960, pp. 413–414.

Photo Lab–Index, 1971, 3–201, 202, 204.07–204.12, 215–216.

Handbook of Photography, 1940, pp. 368–369.

*Primary Examiner*—Mary F. Kelley

[57] ABSTRACT

Lithographic developer in an automatic photographic film processor is replenished from at least two stable solution concentrates. As each quantity of lithographic film is processed predetermined amounts of the solution concentrates and water are mixed and immediately added to the developer. The solution concentrates, stable before mixing, contain all the constituents needed to replenish the developer solution to maintain activity at a desired level. The amount of each solution concentrate is predetermined from the concentration of each solution concentrate and the quantity and developer requirements of the film. The frequency of replenishment is predetermined from the usage pattern.

8 Claims, No Drawings

LITHOGRAPHIC DEVELOPER REPLENISHMENT PROCESS

CROSS REFERENCE TO RELATED APPLICATIONS

This application is a continuation-in-part of application Ser. No. 358,671, filed May 9, 1973, now abandoned, which is a continuation-in-part of application Ser. No. 285,126, filed Aug. 31, 1972, now abandoned.

BACKGROUND OF THE INVENTION

1. Field of the Invention

This invention relates to replenishing photographic silver halide developer solutions. More particularly, this invention relates to replenishing the developer used in automatic processors for lithographic film.

2. Description of the Prior Art

Developer solutions used in automatic photographic film processors are subject to change in composition due to accumulation of development products, e.g., oxidized developer and halide ion, and to developer aging. Such changes are particularly critical in processing lithographic film where the hydroquinone type developer is characterized by high sensitivity to bromide and sulfite ion concentration and where developer stability is characterized by high sensitivity to pH, to aerial oxidation, and to anaerobic degradation. The nature of lithographic development, developers and replenishers has been characterized in prior art studies such as J. A. C. Yule, J. Franklin Inst. 239, 221 (1945); L. F. A. Mason, "Photographic Processing Chemistry", The Focal Press, New York, (1966) pg. 163; D. A. Pullen & M. C. Lloyd, Printing Technology, 14, 69 (1970); L. T. Connolly, TAGA Proceedings, 1970 page 151; R. L. Childers, Photogr. Sci. Eng., 15, 480 (1971); and H. Zwicky, Chimia, 26, 667 (1972). In a commercial lithographic developer hydroquinone is the sole developing agent. To obtain the lith effect with consistent results, the developer must have a low, but constant, sulfite ion concentration along with a constant pH and bromide ion concentration. The sulfite ion concentration is maintained by a sulfite buffer, e.g., sodium formaldehyde bisulfite; during use, however, concentrations of hydroquinone and bromide ion and pH are changed by the development process. Due to the low sulfite concentration and to the presence of buffer components, lith developer at high pH (i.e., substantially above 8) undergoes a time-dependent loss of activity due to aerial oxidation and anaerobic degradation. Thus to obtain reproducible processing, a replenisher solution is normally added to the developer to compensate for changed activity due to prior use or aging. Replenisher, however, contains substantially the same components as developer itself, and consequently is unstable. This poses the problem of attempting to compensate for the deteriorating activity of the developer with a replenisher solution whose activity is also deteriorating. In addition to maintaining developer activity, the concentration of bromide ion in the developer, which modulates development, should be maintained constant. In some automatic processors, means are provided for replenishing the developer periodically by measuring or sensing the activity level of the developer bath and then adding the appropriate amount of replenisher. OLS No. 2,119,069 discloses an automatic developer replenishing system which monitors bromide ion and developing agent concentration and adds, as required, either replenisher with high bromide concentration or replenisher with no or low bromide concentration. Schumacher, OLS No. 2,004,893 discloses a replenishment system containing two separate replenishers in which one replenisher is supplied to the developer on the basis of the quantity and developer requirements of the film being developed, and in which a second replenisher is supplied to the developer on the basis of processor running time. Automatic replenishing systems, such as that of OLS No. 2,119,069, are normally expensive and use premixed replenishers, which, like the developer, are unstable. Consequently, replenisher activity is never the same from one moment to the next, and the replenisher is frequently discarded if not used within a relatively short period of time.

SUMMARY OF THE INVENTION

There has been discovered, according to the invention, a process of replenishing a developer solution whereby the problems of the prior art are avoided by a procedure in which replenisher solution is made up as each quantity thereof is added to the developer to compensate for developer activity lost due to development of a piece or quantity of film. Since the replenisher is prepared and added as each quantity of film is developed, the activity thereby restored to the developer bath will be precisely known and not diminished by the time-dependent degradation of replenisher. This process is for use with hydroquinone type developers, which are subject to degradation at high pH but which may be made up from stable solution concentrates. Accordingly, in the process of developing exposed photographic film in a bath of developer solution, the improvement comprises repetitively replenishing said developer solution with a quantity of replenisher solution which is prepared from at least two stable solution concentrates and added to said bath of developer solution as each quantity of film is developed, said quantity of replenisher solution being predetermined from the concentration of each solution concentrate and the quantity and developer requirements of said film. The developer requirements of photographic film depend primarily on the percent exposure and halide content of the film. The solution concentrates together contain the necessary constituents to replenish the bath of developer solution; however, each individual solution concentrate contains only those constituents which will substantially not interact. Thus, for a lithographic developer, solution concentrate "A" contains hydroquinone and a sulfite buffer at a pH below about 8, solution concentrate "B" contains a base, e.g., free hydroxyl ion, and may contain bromide ion.

As previously stated, a developer solution should have not only a constant level of active hydroquinone developing agent but also a carefully controlled sulfite and bromide ion level. To facilitate replenishment to the proper balance of developer constituents, therefore, there may be employed a third solution concentrate "C" containing bromide or additional sulfite buffer or additional hydroquinone. Additional adjuvants normally used in lithographic developers may be present in each concentrate or in additional solution concentrates. In the practice of this invention large reservoirs of stable solution concentrates can be used, thereby eliminating the inconvenience and expense of discarding and replacing unused premixed replenisher each day. Similarly, disposal problems of the waste, unused, premixed replenisher is eliminated.

Furthermore, the invention enables replenishment to be carried out economically and with precision. Since each quantity of replenisher is prepared and added as each quantity of film is developed, its composition at the time of addition to the developer has not been affected by aging and is therefore precisely known. This permits addition of a given amount of replenisher solution for film of given quantity and developer requirements without the need for expensive and unreliable sensing means.

DESCRIPTION OF THE PREFERRED EMBODIMENTS

In a preferred embodiment of the invention, lithographic developer in an automatic photographic film processor is replenished either just prior to, during or just after development of each sheet of exposed photographic film by metering perdetermined proportions of three stable, solution concentrates, one of which is a solution of a hydroquinone developer at a pH below 8, and mixing the solutions with a metered amount of deionized water to form just enough replenisher to maintain a desired developer activity during the development of the individual sheet. The replenisher can be mixed and immediately introduced into the developer, or alternatively, the solutions and water can be metered directly into the developer. When a single long web of exposed photographic film is processed, developer activity can be maintained by repetitively mixing and adding replenisher in a predetermined time sequence during development. Two of the three solution concentrates can be stable stock solutions normally used to prepare premixed replenisher for automatic photographic film processors. The third solution concentrate can be primarily aqueous potassium bromide solution or it can be one of the two stock solutions with added potassium bromide. A fourth solution concentrate may contain additional sulfite buffer, hydroquinone, or other specific adjuvants.

The process of the invention is particularly useful in replenishing lithographic developers containing a hydroquinone developing agent, i.e., hydroquinone or a derivative thereof which is subject to degradation under development conditions but which can be made up from stable solution concentrates. Representative lithographic developers are described in Valiaveedan, U.S. Pat. No. 3,622,330; Nottorf, 3,325,286; Lowe et al., 3,158,483; Nottorf, 3,142,568; and Henn et al., 3,030,209. Lithographic developers frequently contain the following constituents: hydroquinone as the sole developing agent, 5–75 g; auxiliary solvents, 20–100 g; caustic alkali, 3 or more g; hardeners or hardener adducts, 5–80 g; preservatives or antioxidants, 1–40 g; restrainers, 1 or more g; buffering agents, 20–100 g; Sequestering agents, 0.5–4 g; and water to make 1 liter. Replenisher for such lithographic developers generally contain the same constituents, however, concentrations of some or all constituents may be different. Constituent concentration in replenisher depends on replenishment rate. Solution concentrates useful in the process of the invention will contain a stable mixture of some of the constituents of the replenisher however the constituent concentration generally will be higher and would be limited only by solubility in the solution concentrate. Concentration used will be further restricted by the predetermined replenishment rate. At least two solution concentrates must be used to replenish the developer with the required amount of constituents, and frequently the replenisher constituents are divided into three or more solution concentrates. However, in the preferred embodiment three solution concentrates are used. One solution concentrate, part A, usually contains hydroquinone and a water miscible organic solvent in an aqueous solution with a pH below about 8 and preferably below 7. At a pH above 8, hydroquine rapidly oxidizes in air. Part A frequently contains sulfite buffer such as sodium formaldehyde bisulfite as well as other non basic constituents which are soluble in the organo-aqueous solvent, e.g., sequestering agents, surfactants, preservatives, antifoggants and antioxidants. Auxiliary organic solvents useful in part A are alcohols, glycols like ethylene glycol, diethylene glycol and triethylene glycol and glycol ethers like 2-ethoxyethanol or 2-methyoxyethanol. The second solution concentrate, Part B, is a strongly basic aqueous solution with a pH generally above 9 and frequently contains sulfite buffer; ionic restrainers, e.g., potassium bromide; buffering agents, e.g., borate and carbonate; free sulfite, e.g., sodium sulfite; and surfactants. Part B contains no hydroquinone, since such solutions are unstable at high pH. Basic agents generally used to keep pH above about 9 include, alkali metal hydroxides, ammonium hydroxides, amines, and basic salts, e.g., sodium carbonate, and bicarbonate. The third solution concentrate, Part C, can be a concentrated solution of an individual constituent, e.g., potassium bromide or sodium sulfite, or it can be a concentrated solution of two or more individual constituents, or it can be either Part A or Part B wherein one or more of the constituents' concentrations are increased, e.g., Part B with added potassium bromide. In further aspects of the invention it is apparent that additional solution concentrates, Part D, etc., with components similar to those of Part C can be used. The amount of each solution concentrate used can be expressed in milliliters per square inch of developed silver.

The amount of each solution concentration to be mixed is predetermined from the size of the film sheet to be developed, the extend to which the film was exposed, the type of film used, and the time interval since the developer was last used or replenished. The amount of concentrate used is proportional to the size of film sheets to be developed and the percent exposed area. In the particular case where a reversal film is to be processed, concentrate used is proportional to the percent unexposed area. When a film having silver halide with high bromide content is to be processed, little or no bromide is required in the concentrate, e.g., in, Part B. But, when the silver halide is high in chloride and low in bromide, a commensurate upward adjustment in bromide is required from the concentrate, e.g., either in Part B or Part C, to maintain the developer at a consistent activity. When consecutive sheets of film having the same halide content are to be processed only two suitable solution concentrates are required, Part A and Part B, to replenish the developer before or during development of each sheet. But when film sheets having different halide content are intermixed in consecutive processing at least three solutions concentrates are required, Part A, Part B, and Part C, where Part C contains more bromide than Part B. The processing of a film web may be considered equivalent to processing consecutive sheets of film having the same halide content, the same size (e.g., having the same length and a width equivalent to the film web width) and the same average exposure. In this instance, the commensurate amount of concentrate is metered, mixed and added to the developer at time intervals predetermined from the equivalent film sheets and the rate at which the film passes through the processor. During prolonged periods when film is not being processed, solution concentrates, Part A, Part B and/or Part C, can be metered, mixed and added to the developer at predetermined time intervals to maintain the activity of the developer. The time intervals are predetermined in this instance from known aerial oxidation and anaerobic degradation (e.g., hydroquinone reaction with formaldehyde) effects at the developer temperature or from processed control film strips.

In order to maintain the developer bath at constant activity, it is therefore desired to add replenisher solution or concentrates therefor at fixed intervals based on the amount of film processed and age of the developer. It is preferred that the developer bath be replenished as each quantity of film from about 1 to 20 square inches of film per liter of developer solution in said bath, is developed, to compensate for consumption of developer due to processing and at least as often as once every 16 hours, and more preferably every 15 minutes to 2 hours, during periods of use, including standby for use, to compensate for aerial oxidation and anaerobic degradation of developer. This can be done by adding replenisher solution, or replenisher concentrates, during regular time periods in amounts needed to maintain developer activity during a regular time period when no film is processed, minus the amounts added during the same time period to compensate for film processed. Thus, at the end of a regular time period when no film is processed, the maximum amounts of supplementary solution concentrates will be added to the developer; at the end of a regular time period when a small amount of film is processed, the amount of supplementary solution concentrates will be the maximum amounts required, reduced by the amounts of solution concentrates added to compensate for the processed film; and at the end of a regular time period when a large amount of film is processed and the amounts of solution concentrates required to compensate for the film processed exceeds the amount of supplementary solution concentrates needed when no film is processed, then no supplementary solution concentrates are added. At least two solution concentrates are needed to form the supplementary combination. In a particularly preferred embodiment using this procedure, the first solution concentrate Part A is substantially the same as Part A described above, having pH below 8 and a raised level of developing agent. The second solution concentrate Part C is substantially the same as Part B described above except that concentrations of all components except bisulfite ion will be such that, upon dilution, component concentrations will be the same as the developer. Bisulfite ion concentration in Part C is increased to compensate for the expected time-dependent developer degradation.

Any means known to one with ordinary skill in the art may be used to meter and mix prepared solution concentrates and add the resultant replenisher to the developer of the automatic processor. However, for the process of this invention to be particularly useful the metering, mixing and adding means should be automatically controlled from a predetermined selection of parameters. A suitable control apparatus for carrying out the process of this invention is disclosed in Crowell et al., U.S. Pat. No. 3,822,723.

In practicing this invention the developer requirements of the film to be developed are determined by methods well known in the art. In one instance, it is possible to determine the developer requirements of a particular film type by analysis of the film to determine the amount of silver halide per unit area and type of halide present. Since one mole of developing agent, hydroquinone, is needed to develop one mole of silver halide, the amount of developer used can be determined from an accurate estimate of the percentage of the area of the film that has been exposed (percent exposure) if the constitution of the developer is known or can be analyzed. With the high contrast lithographic films normally used with hydroquinone as the sole developer, exposed areas develop completely, simplifying this calculation. The predetermined amount of Part A solution concentrate contains enough hydroquinone to replace that used in the developer during development. The predetermined amounts of Part B solution concentrate and water are sufficient to maintain the pH and constituent concentrations of the developer. In another instance, where detailed knowledge of the film type, developer constitution and replenisher constitution are not known, it is possible to determine the amounts of replenisher concentrates needed from manufacturers specifications, directions and the provided developer requirements of the film. Conventionally, replenisher is supplied by the manufacturer as two stable solution concentrates, Part A and Part B, along with directions for preparing premixed replenisher therefrom, and directions for adding the premixed replenisher to the developer. Thus X amount of Part A, Y amount of Part B and Z amount of water are mixed to prepare working strength replenisher and Q amount of the replenisher is added for a given area of exposed film to be developed. Since the operator of the processor typically is also the cameraman, the amount of exposed film is estimated from the size of the film and the nature of the material photographed. When the manufacturers information for replenishing a particular film type is inadequate, the processor operator typically determines the amount of replenisher needed empirically by developing a series of pre-exposed control film strips and adjusting the replenishment rate "Q" accordingly. In the practice of this invention, the operator, instead of premixing a working strength replenisher, would add the proper proportion of Part A, Part B, and water directly to the processor, i.e., (QX/X+Y+Z) of Part A; (QY/X+Y+Z) of Part B; and (QZ/X+Y+Z) of water. In addition to the hydroquinone which must be added replenishing, if the film is a silver bromo chloride film, the proper level of bromide ion is added in the replenisher to compensate for the difference between the bromide ion generated during development and the bromide ion lost in the developer solution flowing out through the developer tank overflow when replenisher is added. If the film is a silver bromide film, the film itself adds greater quantities of bromide upon development so that lower amounts of additional bromide are needed in the replenisher solution. An additional replenisher solution concentrate, as previously described, may be conveniently employed to provide the proper bromide ion concentration.

This invention will be further illustrated by, but is not intended to be limited to, the following examples wherein commercially available films were processed in standard developers using commercially available film processors.

EXAMPLE I

Developer solution was prepared having the composition of Example XI (the eleventh formulation in the table of developer compositions), of Valiaveedan, U.S. Pat. No. 3,622,330. The developer solution ( ≅ 64 liters) was put in the developer tank of a LogEtronics Model LD/24 automatic processor (a product of LogEtronics, Springfield, Virginia).

The following replenisher solution concentrates were prepared.

| | |
|---|---|
| **Part A** | |
| Hydroquinone | 190 g |
| Sodium formaldehyde bisulfite | 20 g |
| Ethylene glycol | 600 g |
| Water to make 1 liter | |
| **Part B** | |
| Sodium hydroxide | 40 g |
| Sodium sulfite | 15 g |
| Sodium formaldehyde bisulfite | 320 g |
| Potassium bromide | 5 g |
| Trisodium ethylenediaminetetra-acetate trihydrate | 8 g |
| Sodium metaborate (octahydrate) | 50 g |
| Sodium bicarbonate | 35 g |
| Potassium carbonate (anhydrous) | 130 g |
| Water to make 1 liter | |

A lithographic film containing 30 mole percent AgBr and 70 mole percent AgCl similar to that in Example I in Nottorf, U.S. Pat. No. 3,325,286 was cut into sheets 20 × 24 inches (480 sq. in.). Ten sheets were exposed the same way. Half of each sheet was covered with an opaque mask and an intensity scale step tablet (1 × 7 in.) along with a magenta screen was placed on the uncovered half. Each masked sheet was then exposed for 20 seconds to a white light tungsten source. The exposed sheets were fed into the processor consecutively, the feed rate of the processor being 33 inches per minute. Just as each sheet was introduced metering pumps were activated to meter 40 ml of Part A, 40 ml of Part B and 160 ml of water into a mixing volume from which the mixed replenisher was pumped into the processor developer tank within 20 seconds of activation of the metering pumps. The amount of Part A, Part B, and water were determined as hereinbefore described. Thus one milliliter replenisher per square inch of exposed film area (which is transformed to developed silver) was thereby introduced into the developing tank. Speed, contrast and maximum density of each processed film sheet were substantially the same.

Similar results were obtained when 8 × 10 sheets (80 sq. in.), 75% exposed, were interposed between half exposed 20 × 24 inch sheets. Just as each 20 × 24 inch, half exposed sheet was fed into the processor the developer was replenished as previously described. Just as each 8 × 10 inch, 75% exposed sheet was fed into the processor, 10 milliliters of Part A, 10 milliliters of Part B and 40 milliliters of water were metered, mixed and pumped into the developer. Speed, contrast, and maximum density of each processed film sheet were substantially the same.

EXAMPLE II

A direct positive film containing about 80 mole percent AgBr and about 20 mole percent of AgCl similar to that in Example I of Burt, U.S. Pat. No. 3,445,235 was cut into sheets 20 × 24 inches. Ten sheets were exposed as in Example I except that only 25 percent of each sheet was covered with an opaque mask. Each exposed sheet was processed in developer as in Example I except that in this instance Part B solution concentrate contained no potassium bromide and the following replenishment procedure was used. Thirty seconds after each exposed film sheet was fed into the processor metering pumps were activated to meter 20 ml of Part A, 20 ml of bromide free Part B and 80 ml of water into the mixing volume. One milliliter mixed replenisher per square inch of unexposed positive film area (developed silver) was pumped into the processor developing tank. Speed, contrast and maximum density of each processed film sheet were substantially the same.

EXAMPLE III

Five exposed lithographic film sheets (20 × 24 inches) of Example I and five exposed direct positive film sheets of Example II were processed in developer as in Example I. In this instance three solution concentrates were used, Part A of Example I, bromide free Part B of Example II and Part C which was 5 g potassium bromide in water to make 0.1 liter. Just before an exposed sheet of direct positive film was fed into the automatic film processer Part A, Part B and water were metered, mixed and pumped into the developer tank of the processor as in Example II. Just before a sheet of the lithographic film was fed into the processor 40 ml of Part A, 40 ml of Part B, 4 ml of Part C and 156 ml of water were metered, mixed and pumped into the processor developing tank. On sensitometric evaluation speed contrast and top density of the direct positive film sheets were essentially the same, and similarily, speed contrast and top density of the lithographic film sheets did not substantially change. The order in which the two types of film were processed did not appear to affect the sensitometry.

EXAMPLE IV

An eight foot long, ten inch wide web of Lithographic film having a composition similar to that of Example I was uniformly exposed for 2 seconds to a white light tungsten source. One end of the web was fed into a LogEtronics Model LD/24 automatic processor containing the developer solution of Example I. Solution concentrates Part A and Part B were prepared as in Example I. Just as the leading edge of the web was fed into the processor, metering pumps were actuated to meter 13 ml of Part A, 13 ml of Part B, and 52 ml of water directly into the processor developer tank. As the web was being fed into the processor the metering pumps were repetitively reactivated at 8 inch intervals (i.e., every 15 seconds for a feed rate of 33 inches per minute) to meter 13 ml of Part A, 13 ml of Part B and 54 ml of water into the processor developing tank. Density over the length of the processed film web was substantially the same, i.e., 3.5 as measured with a standard transmission densitometer.

EXAMPLE V

Developer solution (64 liters) with the following composition was prepared and put in the developer tank of the LogEtronics LD/24 automatic processor.

| | |
|---|---|
| Hydroquinone | 20 g |
| Ethylene glycol | 70 g |
| Sodium formaldehyde bisulfite | 42.5 g |
| Sodium sulfite | 6 g |
| Sodium bromide | 1.75 g |
| Sodium carbonate | 12.5 g |
| Sodium bicarbonate | 4.75 g |

-continued

| | |
|---|---|
| Trisodium ethylenediaminetetra-acetate trihydrate | 1 g |
| Sodium hydroxide | 4.5 g |
| Sodium metaborate octahydrate | 6 g |
| Water to make 1 liter | |

Replenisher solution concentrates were prepared having the following composition:

| | |
|---|---|
| **Part A** | |
| Hydroquinone | 170 g |
| Ethylene glycol | 420 g |
| Sodium formaldehyde bisulfite | 178 g |
| Water to make 1 liter | |
| **Part B** | |
| Sodium formaldehyde bisulfite | 77 g |
| Sodium sulfite | 40 g |
| Sodium carbonate | 75 g |
| Sodium bicarbonate | 28.5 g |
| Trisodium ethylenediaminetetra-acetate trihydrate | 6 g |
| Sodium hydroxide | 27 g |
| Sodium metaborate octahydrate | 36 g |
| Water to make 1 liter | |
| **Part C** | |
| Sodium bromide | 6 g |
| Part B solution concentrate | 1 liter |

Lithographic film sheets, 20 × 24 inches, were prepared and exposed as in Example I. Just as each exposed sheet was fed into the automatic processor metering pumps were activated to meter 40 ml of Part A, 40 ml of Part C and 160 ml of water into a mixing volume from which the mixed replenisher was pumped into the processor developer tank. Speed, contrast and maximum density of each processed film sheet were substantially the same.

Direct positive film of Example II was cut into sheets 8 × 10 inches. Each sheet was exposed as in Example I and fed into the automatic processor. Just as each half-exposed sheet was fed into the processor metering pumps were activated to meter 6.5 ml of Part A, 6.5 ml of Part B and 27 ml of water into a mixing volume and pump the resulting mixed replenisher into the processor developer tank. Sensitometry for each of the exposed sheets was substantially the same.

EXAMPLE VI

Developer and solution concentrate Part A was prepared as in Example V. Solution concentrate Part B was prepared from 1 liter of Part B of Example V, 10.5 g sodium bromide and 60 g sodium sulfite. Speed and dot quality obtained with the developer in Du Pont Cronalith 24L processor (developer tank ≅ 75 liters) was immediately determined using the method described in Example I of U.S. Pat. No. 3,622,330. Midtones, shadows and highlights of the processed halftone strips were excellent. The processor was not used for 16 hours, but developer temperature was maintained at 80° F. After this time, speed had dropped by about 10% and dot quality was acceptable. The original speed and dot quality were restored by replenishing the developer by activating the metering pumps to meter 330 ml Part A, 330 ml Part B, and 1340 ml of water into a mixing volume from which the mixed replenisher was pumped into the developer tank. Subsequently, every 2 hours a timer activated the pumps by which means 40 ml Part A, 40 ml Part B, and 160 ml of water were metered, mixed and pumped into the developer tank. The same two prepared solution concentrates were used for days until the reservoirs were near empty. During this time replenishment based on use was carried out as described in the previous Examples. Just before the reservoirs were refilled with replenisher solution concentrates, speed and dot quality were determined to be near the speed and dot quality of the original developer solution.

EXAMPLE VII

Lithographic film sheets, 20 × 24 inches, were prepared, exposed and processed as in Example I except that addition of replenisher was by the following procedure. Part A was prepared by diluting Part A of Example I with water to make 3 liters of solution. Part B was prepared by diluting Part B of Example I with water to make 3 liters of solution. Just as each half-exposed, 20 × 24, lithographic film sheet was fed into the processor 120 ml of Part A and 120 ml of Part B were metered into a mixing volume from which the mixed replenisher was pumped into the processor developer tank. Speed, contrast and maximum density of each processed film sheet were substantially the same as that obtained in Example I.

EXAMPLE VIII

Developer solution concentrates were prepared having the following composition:

| | |
|---|---|
| **Part 1** | |
| Hydroquinone | 120 g |
| Ethylene glycol | 420 g |
| Sodium formaldehyde bisulfite | 178 g |
| Water to make 1 liter | |
| **Part 2** | |
| Sodium formaldehyde bisulfite | 77 g |
| Sodium sulfite | 12 g |
| Sodium bromide | 10.5 g |
| Sodium carbonate | 75 g |
| Sodium bicarbonate | 28.5 g |
| Trisodium ethylenediaminetetra-acetate trihydrate | 6 g |
| Sodium hydroxide | 27 g |
| Sodium metaborate octahydrate | 36 g |
| Water to make 1 liter | |

Replenisher solution concentrates were prepared having the following compositions:

| | |
|---|---|
| **Part A** | |
| Hydroquinone | 50 g |
| Part 1 | 1 liter |
| **Part B** | |
| Sodium formaldehyde bisulfite | 77 g |
| Sodium sulfite | 40 g |
| Sodium bromide | 6 g |
| Sodium carbonate | 75 g |
| Sodium bicarbonate | 28.5 g |
| Trisodium ethylenediaminetetra-acetate trihydrate | 6 g |
| Sodium hydroxide | 27 g |
| Sodium metaborate octahydrate | 36 g |
| Water to make 1 liter | |

A supplementary solution concentrate was prepared having the following composition:

| | |
|---|---|
| **Part C** | |
| Sodium bisulfite | 23 g |
| Part 2 | 1 liter |

Developer solution having the composition 1 liter Part 1, 1 liter Part 2 and 4 liters water was put in the developer tank ( ≅ 75 liters) of a Du Pont Cronalith 24

L processor. Speed and dot quality was immediately determined with the developer as in Example I of U.S. Pat. No. 3,622,330. Midtones, shadows, and highlights of the processed halftone strips were excellent. The processor was kept on but not used for 2 hours and developer temperature maintained at 80° F. At the end of the two-hour period, 0.5 liters of Part A, 0.5 liters of Part C, and 2 liters of water were metered into the developer tank to maintain speed and dot quality at substantially their original values. During the second two hours several exposed sheets of lithographic film similar to that in Example I of Nottorf, U.S. Pat. No. 3,325,286 were processed and the developer tank replenished as in Example V. Thus, during this time period 83 ml of Part A, 83 ml of Part B, and 332 ml of water were metered into the developer to compensate for the film processed. At the end of the second two hours 417 ml of Part A, 417 ml of Part C, and 1668 ml of water were added to the developer to maintain speed and dot quality at their original values. During the third two-hour period a substantial amount of lithographic film was processed and 0.52 liters of Part A, 0.52 liters of Part B, and 2.08 liters of water were added to the developer to compensate for the film processed. Since the amount of replenisher, i.e., 0.52 l of Part B, added during this two-hour period exceeded the amount of supplementary solution concentrate, i.e., 0.51 of Part C, needed to maintain developer activity during a two-hour period of no use, no supplementary Part A and Part C was added to the developer at the end of the third two-hour period. Speed and dot quality obtained at the end of this third time period were found to be substantially the same as the original values. The processor was operated eight hours a day, five days a week for three weeks. During the time the processor operated, film was processed intermittently with concurrent replenishment by Parts A and B, and every two hours supplementary replenisher Parts A and C was added to the developer when needed, i.e., ml of Part C = 0.5 – ml Part B used during time period, ml Part A = ml Part C, and ml water = 4 X ml Part C. During the three-week period developer activity as measured by speed of processed film was maintained within about 5% of the original value.

We claim:

1. In a process of developing imagewise-exposed lithographic film in a bath of lith developer solution contained in an automatic photographic film processor, said solution containing hydroquinone as the sole developing agent and having a low sulfite ion concentration characterized by a high sensitivity to pH, to bromide ion, and to sulfite concentration changes, and being subject to aging due to aerial oxidation and anaerobic degradation, and wherein pH and concentrations of hydroquinone and bromide ion are changed by the development process and wherein quantities of premixed replenishers are added to said bath to compensate for concentration changes due to development and to aging, the improvement comprising: replenishing said bath of lith developer solution to compensate for concentration changes due to development by repetitively adding to the developer solution as each quantity of film is developed, in combination:

1. a quantity of a stable solution concentrate A having a pH below 8 and consisting essentially of an aqueous solution of sufficient hydroquinone to replace that consumed during development of each quantity of film,
2. a quantity of stable solution concentrate B consisting essentially of a strongly basic aqueous solution having a pH above 9, and free of developing agent, the amount of concentrate B being sufficient to maintain the pH and constituent concentration of the developer; and wherein A, B, or A+B contains sodium formaldehyde bisulfite in an amount sufficient to act as a buffer for sulfite ion concentration.

2. The process of claim 1 wherein solution concentrate A, B, or A+B contains bromide ion.

3. The process of claim 1 wherein each solution concentrate is diluted with water as it is added to the developer.

4. The process of claim 1 wherein each solution concentrate is added directly to the developer, and water is separately added to the developer.

5. The process of claim 1 wherein a plurality of films are developed having differing bromide contents, and wherein solution concentrates A and B are substantially free of bromide ions, and wherein a third solution concentrate comprising aqueous bromide solution is added in combination with solution concentrates A and B to adjust commensurately for the bromide content of said film being developed so as to maintain the developer at a consistent bromide concentration.

6. The process of claim 5 wherein the third solution concentrate consists essentially of solution concentrate A or B with added bromide ion.

7. In a process of developing imagewise-exposed lithographic film in a bath of lith developer solution contained in an automatic photographic film processor, said solution containing hydroquinone as the sole developing agent and having a low sulfite ion concentration characterized by a high sensitivity to pH, to bromide ion, and to sulfite concentration changes, and being subject to aging due to aerial oxidation and anaerobic degradation, and in which pH and concentrations of hydroquinone and bromide ion are changed by the development process and quantities of premixed replenishers are added to said bath to compensate for concentration changes due to development and to aging, the improvement comprising: replenishing said lith developer solution to compensate for concentration changes due to development by repetitively adding to the developer solution as each quantity of film is developed, in combination:

1. a quantity of a stable solution concentrate A having a pH below 8 and consisting essentially of an aqueous solution of sufficient hydroquinone to replace that consumed during development of each quantity of film,
2. a quantity of stable solution concentrate B consisting essentially of a strongly basic aqueous solution having a pH above 9 and free of developing agent, the amount of concentrate B being sufficient to maintain the pH and constituent concentration of the developer; and wherein A, B, or A+B contains sodium formaldehyde bisulfite in an amount sufficient to act as a buffer for sulfite ion concentration, and replenishing to compensate for developer aging by repetitively adding to the developer at predetermined time intervals, in combination, a quantity of stable solution concentrate A and a quantity of stable solution concentrate C, the latter consisting essentially of solution concentrate B with increased bisulfite and bromide ion concentration; the amount of A and C added being sufficient to maintain original speed and dot quality.

8. The process of claim 7 wherein concentrates A and C are added to the developer at regular time intervals in an amount equal to that which would be necessary to maintain a constant level of activity in the developer if no film were developed, minus the amount of replenisher A and B which was added during the previous time interval to compensate for consumption of developer due to film development.

* * * * *